United States Patent [19]

Romanzi, Jr.

[11] 3,996,648

[45] Dec. 14, 1976

[54] SEAT BELT BUCKLE

[75] Inventor: Louis Romanzi, Jr., Milford, Mich.

[73] Assignee: Gateway Industries, Inc., Chicago, Ill.

[22] Filed: June 11, 1975

[21] Appl. No.: 586,024

[52] U.S. Cl. ..... 24/230 A

[51] Int. Cl.[2] ..... A44B 11/26

[58] Field of Search ..... 24/201 D, 230 A, 230 AK, 24/230 AP, 230 AV, 230 AL, 230 SC, 75, 77 R, 78

[56] References Cited

UNITED STATES PATENTS

| | | | |
|---|---|---|---|
| 3,237,258 | 3/1966 | Fisher | 24/77 R |
| 3,491,415 | 1/1970 | Hughes | 24/230 A |
| 3,574,902 | 4/1971 | Lohr | 24/230 A |
| 3,686,720 | 8/1972 | Wehner | 24/230 A |
| 3,790,994 | 2/1974 | Jakob | 24/230 A |
| R26,754 | 1/1970 | Fisher | 24/230 A |

*Primary Examiner*—Donald A. Griffin
*Attorney, Agent, or Firm*—Fitch, Even, Tabin & Luedeka

[57] ABSTRACT

A push-button safety buckle, which is used to fasten together ends of safety belts about passengers, is constructed with an inverted channel-shaped, metallic, load-bearing buckle body encapsulated in a surrounding, nonload bearing plastic housing. Because the buckle body is encapsulated, the conventional and expensive chrome plating of the buckle body is eliminated. An overhead plate on the inverted channel-shaped body provides crush resistance to the buckle. An aperture formed in the overhead plates allows access to and operation of a unitary latch lever pivotally mounted within the buckle body.

13 Claims, 8 Drawing Figures

SEAT BELT BUCKLE

This invention relates to a safety belt buckle and more particularly to a safety belt buckle of the pushbutton kind used to fasten together ends of safety belts about a passenger and used extensively in automobiles, airplanes or other vehicles.

Pushbutton safety belt buckles used in automobiles must meet rigorous federal safety standards and, to this end, these buckles are subject to a wide series of tests to assure they release under adverse conditions and that they withstand loads in the transverse, lateral or straight tension directions. In order to be acceptable commercially to an automotive company for installation on a large scale basis, the seat buckle design must not only meed federal safety standards but it also must be competitively priced and aesthetically acceptable. For instance, a safety belt buckle which meets the safety requirements may be too heavy and too uncomfortable when resting in the wearer's lap to be acceptable from an aesthetic standpoint. Or, the buckle may be too large and bulky to be acceptable for automobile usage. Large and heavy safety belt buckles could be dangerous at the time of an accident if allowed to fly freely through the air and strike a passenger.

One safety belt buckle which has been found satisfactory and has been produced in large quantities and used extensively in automobiles is disclosed in U.S. Pat. No. 3,605,209. The pushbutton operating mechanism of the buckle comprises a latching lever and a separate actuating lever mounted on a pivot pin shaft extending between upstanding flanges of a channel-shaped base. A plastic cover is attached to the base and covers the latching mechainsm. The use of an actuating lever or actuating pieces in addition to the latching lever adds to the cost and weight of the buckle. Another item of expense in the aforesaid buckle is the chrome plating of the buckle base to improve its appearance.

While this buckle has provided eminently satisfactory, others have attempted to produce less expensive buckles by eliminating the chrome plated buckle base; and by using other shapes of load bearing members within a non-load bearing plastic housing. However, when substituting a load bearing member for the chrome plated channel base, the buckle employed a large number of complexly-shaped latching elements which added significantly to the cost and to the depth of the buckle.

In assembling the seat belt buckle of U.S. Pat. No. 3,605,209, the upstanding flanges on the channel-shaped buckle base were spread to admit the ends of the pivot pin and the pivotal ends of the latch lever and then the spread flanges were released to spring back to capture and retain the ends of the pivot pins and latch lever. This flange spreading operation has been eliminated in some buckles which, for example, drop the latch assembly components downwardly into a load bearing die cast body housing. The weight of the die cast body housing is, however, heavy and a large number of parts are used for the latching mechanism in this type of buckle. Generally speaking, these buckles using a unidirectional assembly technique have employed a considerable number of parts which have added to both the weight and the cost of the buckle. Thus, there is a need to provide a lower cost seat belt buckle which incorporates the claimed advantages for the above-described buckles and also eliminates many of their disadvantages.

Accordingly, a general object of the invention is to provide an improved, as contrasted with the prior art, commercially acceptable seat belt buckle of the pushbutton kind.

A further object of the invention is to provide a pushbutton buckle having a simple latching mechanism and load bearing buckle body encapsulated in a non-load bearing plastic housing.

Other objects and advantages of the invention will become apparent from the detailed description taken in connection with the accompanying drawings in which.

Figure 1:
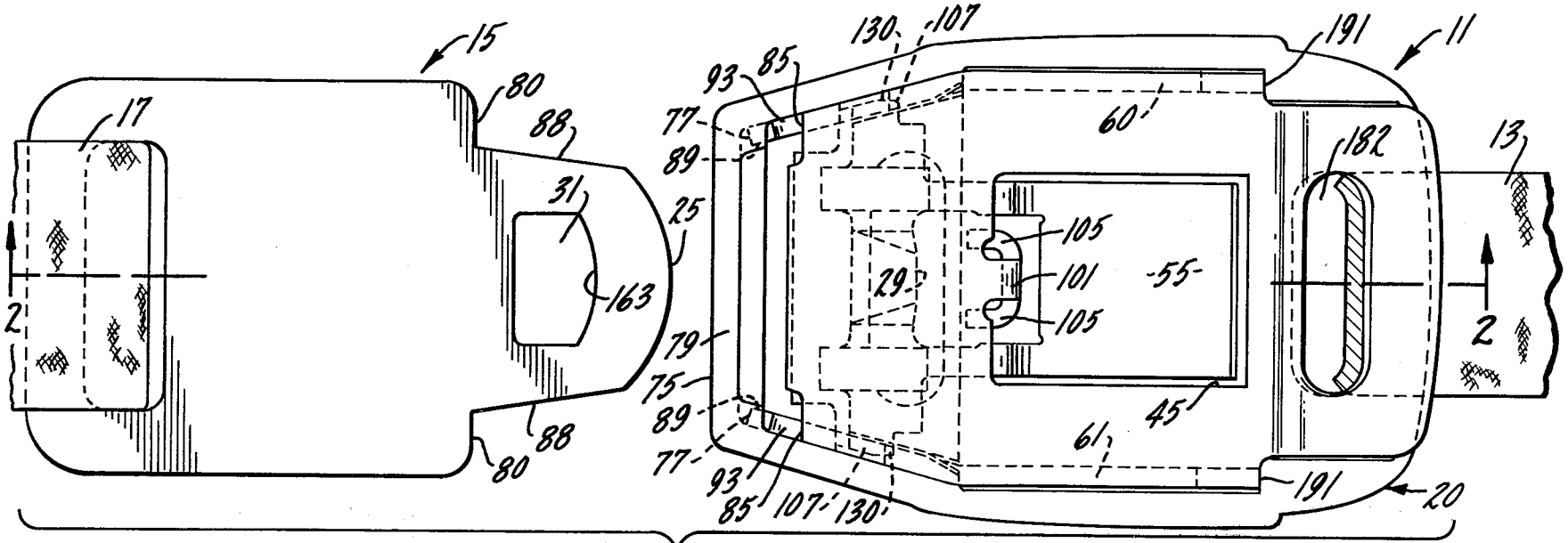
FIG. 1 is a plan view of a safety belt buckle constructed in accordance with the preferred embodiment of the invention.

As shown in the drawings for purposes of illustration, the present invention is embodied in a seat belt buckle 11 which is fastened at one end to a belt webbing 13 and which includes a D-ring or tongue plate 15 fastened to an end of another belt webbing 17. A leading end 25 on the tongue plate 15 is sized to be inserted into an entry slot 19 in one end of the buckle 11; and, as the tongue plate 15 slides inwardly within a buckle housing 20 towards the latched position shown in dotted lines in FIG. 2, the leading edge 25 engages a latch dog 29 on a latch lever 35 and pivots the latter against the force of a biasing spring means 33 until a latch opening 31 in the tongue plate is aligned with the latch dog 29 which is then free to snap into the latch opening as the latch lever is returned by the biasing force of the spring means 33. The latch lever 35 is pivotally mounted on a metallic, load bearing buckle body 37 of high strength metal. Thus, the load from the tongue plate 15 will pass therefrom to the latching lever 35 and to the buckle body 37 and then to the other belt webbing 13.

In accordance with the present invention, a commercially acceptable, readily assembled buckle 11 of light weight and low cost is achieved by pivotally mounting a unitary latching lever 35 in a channel-shaped load bearing buckle body 37 encapsulated in the surrounding, non-load bearing plastic housing 20. Because the buckle body 37 is not exposed, it need not be chrome plated. As will be explained, the latch lever 35 may be assembled and pivotally mounted without spreading flanges of the channel-shaped body. Strength, rigidity and crush resistance are imparted to the buckle 11 by the novel positioning of and shaping of the channel-shaped buckle body 37 in an inverted position within the plastic housing 20 so that an overhead plate 43 on the buckle body extends substantially across the entire top area of the buckle. An opening 45 is provided in the overhead plate 43 to permit pushbutton actuation of an upper end 55 of the latch lever 35 of the latching mechanism 36. The latching mechanism 36 may be extremely simple and comprise but a unitary latching lever 35 and a one-piece spring means 33 and still afford the necessary force and distance multiplication to allow operation by children and women and to provide sufficient travel of the latch dog 29 from its latching engagement with the tongue plate to release the tongue plate.

Figure 3:
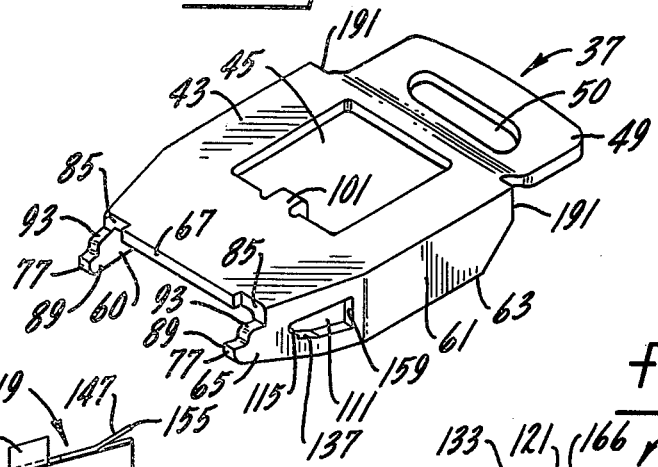
FIG. 3 is a perspective view of the buckle body used in the safety belt buckle of FIG. 1.
Figure 8:
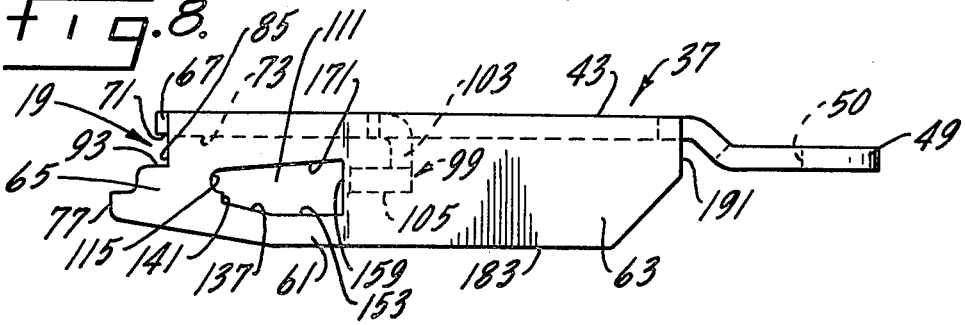
FIG. 8 is a side elevational view of the buckle body shown in FIG. 3.

Proceeding now with a more detailed description of the individual elements of the safety belt buckle 11, the buckle body 37, as best seen in FIGS. 3 and 8, by means of its channel-shaped configuration provides a strong load bearing member for transferring the load from the belt webbing 17, the tongue plate 15 and latching lever 35 to the other belt webbing 13. Preferably, the overhead plate 43 of the buckle body is generally planar and extends the breadth and length of the buckle from a forward lip or end 67 defining a portion of the entry slot 19 to a rearward belt connecting flange 49 having an aperture 50 through which is looped the belt webbing 13. Because, as can best be seen in FIGS. 1 and 3, the overhead plate 43 extends substantially the entire width and length of the buckle, it provides crush resistance eliminating the need for separate crush resistant bars as disclosed in the aforementioned U.S. Pat. No. 3,605,209 for strengthening its plastic cover against crushing. Crush resistance is particularly important on the top or upper side of the buckle as it is this top side of the buckle which may be hit by hard rigid parts of the vehicle. The underside of the buckle will be in engagement with the softer body of the wearer.

The buckle body 37 is not chrome plated because it is substantially covered by the plastic housing 20. Herein, the weight of the buckle body 37 is substantially reduced by the large, generally rectangularly shaped opening 45 centrally located in the overhead plate 43, the opening 45 being sized to accommodate movement therethrough of the finger-actuated upper end 55 of the latch lever 35. A similarly shaped access opening 57 is formed in the plastic housing 20 in alignment with the opening 45 in the buckle body to allow the user to depress the upper end 55 of the latch lever. The top surface of this upper end 55 of the latch lever usually carries a decal or a pushbutton which is located slightly below the top surface of the housing.

In accordance with a preferred embodiment of the invention, the inverted channel-shaped buckle body 20 is provided with a pair of depending flanges 60 and 61 which function to guide and constrain the tongue plate 15 in its travel into the latching position and which also function to carry and support the spring means 33 and the latching lever 35. The preferred depending flanges 60 and 61 extend generally longitudinally along and extend downwardly and generally perpendicularly to the overhead plate 43. Herein, the depending flanges 60 and 61 are integral with and bent downwardly from the overhead plate 43 by progressive dies in a known manner. The size of the buckle 11 and its tongue plate 15 are reduced by forming a tapered, tongue inlet end on the buckle body and the housing 20. Herein, the depending flanges 60 and 61 each are formed with large, generally parallel sections 63 spaced at a first distance and located centrally and each are formed with converging inclined flange sections 65 at the forward, tongue entry end of the buckle.

Figure 2:
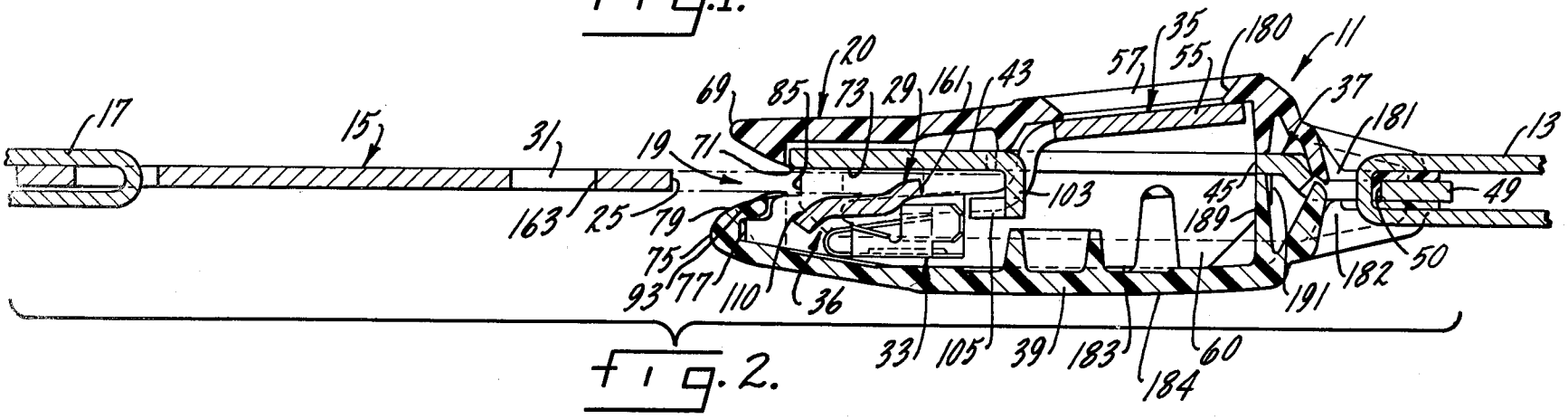
FIG. 2 is a cross-sectional view taken substantially along line 2—2 in FIG. 1.

These tapered flange sections 65 of the depending flanges 60 and 61 co-operate with the plastic housing 20 and with a flange lip 67 on the overhead plate 43 to define the entry slot 19 for the tongue plate 15. More specifically, as best seen in FIGS. 2 and 8, the entry slot 19 includes a rectangular, horizontally extending slot in a front end wall 69 of the plastic housing 20. The housing front end wall 69 abuts and covers the upper surface of the upturned flange lip 67. A lower surface 71 on the lip 67 is slightly exposed through the slot and functions as a guiding surface to guide the leading edge 25 and tongue plate 15 along the underside 73 of the overhead plate 43 into a position for proper latching. The front end wall 69 has a lower portion 75, as shown in FIG. 1, which spans and covers the gap between the flange sections 65 and, at the slot, has an upwardly beveled surface 79 for guiding the leading end of the tongue plate upwardly toward the underside 73 of the overhead plate 43 to travel therealong during tongue plate insertion.

The buckle body 20 also serves to constrain and position the tongue plate in proper position relative to the latch dog 29 to insure and to maintain good latching engagement therebetween. To this end, the upper forward ends of the buckle flange sections 65 are notched, as best seen in FIG. 3, to provide a vertical wall 85 and a horizontal wall 93. Tongue plate insertion is limited by engagement of shoulders 80 of the tongue plate 15 with the vertical end walls 85 (FIGS. 3 and 8) on the respective flange sections 65. When the tongue plate 15 is fully inserted to abut its shoulders 80 with the vertical end walls 85, adjacent surfaces 88 on the tongue plate 15 will be closely adjacent the interiorly facing corners 89 (FIG. 1) of the flange sections 65 to constrain the tongue plate against lateral shifting movement relative to the buckle body and also relative to the latch dog 29. The portion of the tongue plate adjacent the shoulders 80 is also constrained against downward movement from the undersurface 73 of the overhead plate 43 by the horizontal walls 93 formed in the flange sections 65 adjacent the vertical end walls 85 which engage the underside of the tongue plate 15 adjacent the shoulders 80. The leading end 25 of the tongue plate 15 is further constrained against pivoting downwardly by a hook-shaped plate stripper 99 formed on the buckle body 37.

The primary function of the stripper 99 is, however, to strip the tongue plate 15 from the latching dog 29 should the leading end 25 of the tongue plate 15 try to follow the latching dog 29 downwardly during operation of the pushbutton. Herein, the hook-shaped tongue stripper 99 includes an upper integral, horizontal portion 101 which is connected to the overhead plate 43 and which projects rearwardly into the opening 45 and then is bent downwardly to provide an integral downwardly extending portion 103 from which extend a pair of reentrantly-bent, forwardly extending tabs 105 as best seen in FIG. 1. The top surfaces of these tabs 105 are spaced from and parallel to the underside 73 of the overhead plate 43 and are positioned immediately below the lower surface of the tongue plate when it is fully inserted as shown in FIG. 2.

A forward end 110 of the latching lever 35 is curved and bent downward to provide an upper convex surface to the leading edge of the tongue plate to assure that the leading edge 25 of the tongue plate 15 is guided onto the top of an inclined camming surface 108 on the latching lever 35 during tongue insertion. This curved end 110 on the latching lever prevents insertion of the leading end 25 of the tongue plate under the laching plate 35 which would give a false latching impression to the user.

To provide a long lever arm for the latching lever 35 and still center its pushbutton upper end 55 in the center of the buckle 11, the latching lever 35 is pivotally mounted at the forward end of the buckle for turning about a pivot axis which is parallel to the overhead plate 43. In this preferred embodiment of the invention, the latch dog 35 is pivotally mounted on the depending flanges 60 and 61 by laterally projecting pivot ears 107 which extend laterally outward and into openings 111 formed in the depending flange sections 65 in each of the depending flanges 60 and 61. The slots 111 are considerably larger than the pivot ears 107 and the pivot ears are held in position whthin the slots 111 by portions of the spring means 33 which force forwardly facing end walls 113 on the ears 107 into pivoted abutment with arcuately-shaped bearing walls 115 at the forward ends of the respective slots 111.

Figure 6:
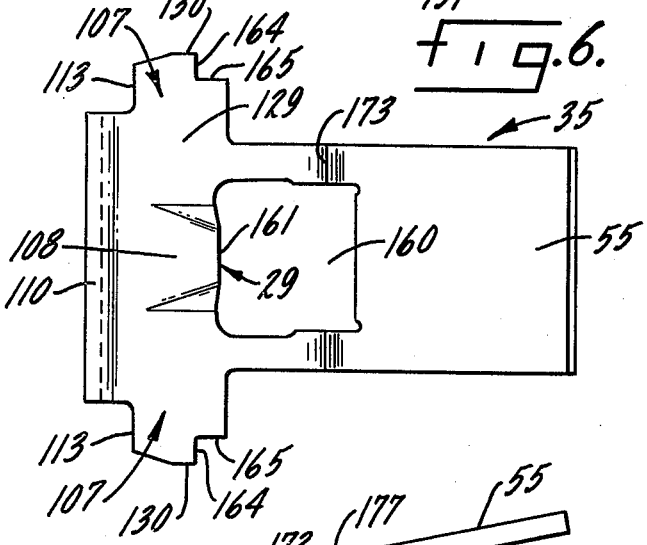
FIG. 6 is a plan view of a unitary latching lever for use in the safety belt buckle of FIG. 1.

In accordance with the present invention, the illustrated spring means 33 comprises an elongated, laterally extending spring body 117 having a generally flat central plate portion 118 with a raised oblong reinforcing portion extending laterally between the flange sections 65. The opposite ends of the spring body 117 are formed with end sections 119 which mount the spring in the respective slots 111 in these depending flange sections 65, as will be explained. The latch lever 35 is biased to its upward, return position by leaf springs 121 which are upwardly and rearwardly inclined from and spaced above the plate section 118 of the spring body 117 and which abut the underside of the latch lever 35. The leaf springs 121 are flat in shape and are integrally connected at their forward rounded portions 127 to the plate portion of the spring body. The leaf springs 121 engage the latch lever 35 on opposite sides of its centrally disposed latch dog 29, as best seen in FIGS. 1 and 6, and engage the underside of the latch lever 35 at a wide transversely extending portion 129 thereof, the pivot ears 107 being formed on the outer ends of the portion 129. When the spring body is positioned, leaf springs 121 are flexed to urge the latch lever to pivot upwardly about the abutted surfaces 113 and 115 into the position shown in FIG. 2 until the upper pushbutton end 55 of the latch lever is depressed.

The preferred manner of assembly of buckle is a "drop-in" assembly operation in which the spring means 33 and the latching lever 35 are positioned and secured in place without having to spread the depending flanges 60 and 61. More specifically, as best seen in FIG. 1, the transverse distance between outer edges 130 of transverse portion 129 is less than the distance between the inner facing sides of the depending flanges 60 and 61 so that the ears 107 may be readily inserted from the wide end of the inverted channel buckle body. If the buckle body 37 is disposed vertically with its webbing receiving flange 49 uppermost, the latch lever ears 107 may be inserted on a down stroke of a machine into the slots 111 and moved downwardly therein until the pivot edges 113 of the ears abut the arcuate pivot surfaces 115.

Figure 4:
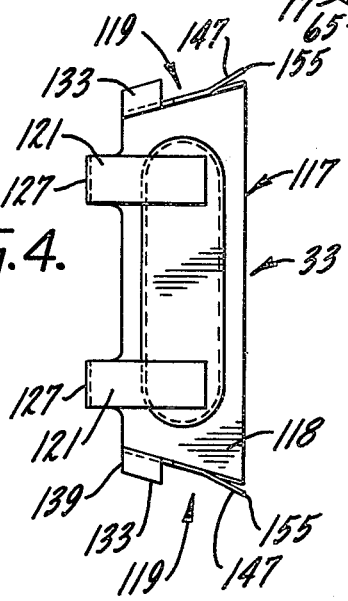
FIG. 4 is a plan view of a spring means used in the safety belt buckle of FIG. 1.

Also, in the same or in a similar downward linear motion, the spring body 33 may be readily positioned within the same receiving slots 111 and interlocked with the depending flanges 60 and 61 as will now be described in greater detail. To these ends, each of the ends 119 of the spring body 117 is provided with a laterally extending tab or wing 133, as best seen in FIG. 4, which is inserted into a slot 111 with the underside 135 of each wing 133 engaging a downwardly and rearwardly inclined lower wall 137 (FIG. 8) defining a portion of the lower side for each slot 111. The forward movement of the spring body 117, as it is being inserted into the slot, is arrested when a leading edge 139 on each wing 133 abuts a vertical shoulder wall 141 formed on the lower side of each slot 111. The wings 133 are bent horizontally outwardly from upstanding side walls 145 on the spring body, these upstanding side walls 145 being tapered for disposition along the inner sides of the respective converging flange sections 65 of the buckle body. These upstanding side walls 145 are bent upwardly from the transversely extending plate section 118 of the spring body.

Figure 5:
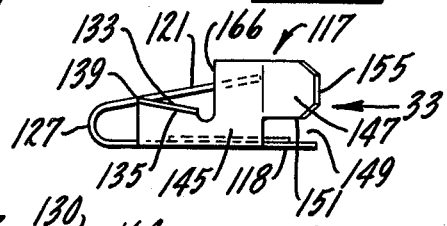
FIG. 5 is a side elevational view of the spring means of FIG. 4.

The spring body 117 is locked against shifting in a rearward direction relative to the receiving slots 111 by spring detents 147, as best seen in FIG. 4, which are formed on the spring body to project laterally outwardly of the plane of the upstanding side walls 145 of the spring body for the purpose of projecting into the slots 111 and to bringing their rear, vertically extending ends 155 into engagement with vertical, rear end walls 159 of the slots 111. The respective detents 147 are formed in the upper rear corner portions of the vertical side walls 145 and are separated by a lower horizontal slot 149, as best seen in FIG. 5, from the lower rearward positions of the spring body. The detents 147 have lower edges 151 as defined by the slots 149 and these lower edges 151 are adapted to rest on a generally horizontally extending wall 153 at the rear and bottom portions of the respective slots 111.

It will be seen that in the straight-line insertion of the spring body 117, the wings 133 are transported into the slots 111 to abut their lower sides 135 on the inclined walls 137 of the slots and to abut their forward edges 139 against the vertical slot walls 141 of the slots 111. As the wings 133 are moving into position, the ends of the detents 155 are being flexed inwardly by the converging inner sides of the converging flange sections 65 until the slot end wall 159 is reached whereupon detents 147 are free to flex laterally outwardly and to project into the slots 111 to position their ends 155 for engagement with slot end walls 150, as best seen in FIG. 2. It will be appreciated that the bottom wall 39 of the plastic housing may also be formed with a portion to engage and support the plate section 118 of the spring body when the housing 20 is fitted about the buckle body.

Figure 7:
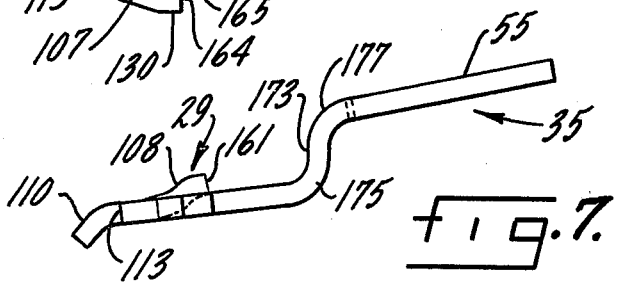
FIG. 7 is a side view of the latching lever of FIG. 6.

In accordance with this preferred embodiment of the invention, the latch lever 35 is formed in one piece which thereby eliminates the multiple pieces and assemblies of actuating levers and latch levers used heretofore to provide force and/or distance amplification for shifting the latch dog 29 between the latching and the releasing positions. The latch dog 29 is preferably formed by a stamping operation on the section 129 of the latch lever at a location adjacent one edge of an aperture 160. The central portion of the latch dog 29 has an abutting edge 161 located above the plane of the section 129, as best seen in FIG. 7, to define the abutting edge for projecting into the opening 31 in the tongue plate to abut a forward edge or surface 163 on the tongue plate. Thus, in the latching position, the abutment edge 161 of the latch dog 29 engages the abutment surface 163 of the tongue plate and transverses the load from the tongue plate to the latch lever 35 and buckle body 37. In the latching position, the flat top surfaces of the pivot ears 107 are in flush engagement with the rearwardly and upwardly inclined walls 171 defining the tops of the slots 111. When the latch lever is pivoted to the release position to lower the latch dog 29, the top flat surfaces on the pivot ears 107 swing downwardly to positions spaced from the top inclined walls 171 of the slots 111. For the purpose of centering and holding the latch lever 35 against lateral shifting and against fore and aft shifting, the latch lever 35 is formed with portions in the form of notched walls 164 and 165 which engage the ends 119 of the spring body 117 to be held thereby. More specifically, the upstanding vertical walls 145 on the spring body are positioned inwardly of and adjacent the walls 165 on the latch lever to hold it against lateral shifting and forward vertical edges 166 on these spring walls are positioned adjacent the walls 164 on the latch lever to hold the pivot ears against rearward shifting movement in the slots 111.

On the latch lever 35 between the latch dog 29 and the pushbutton end 55 is an intermediate section 173 which extends upwardly and rearwardly from the latch dog 29. In this instance, the illustrated intermediate section 173 is bent with a pair of reverse curves 175 and 177 between which is located a central vertical portion 173, as best seen in FIG. 7. The upper end 55 of the latch lever is inclined upwardly through the opening 45 and a horizontal pushbutton may be fastened to the upper end of the inclined end 55 of the latch lever. In accordance with another embodiment of the invention, the upper end of the latch lever may be horizontally disposed with a pushbutton fastened to the horizontally disposed end of the latch layer.

The plastic housing 20 is a nonstructural non-load bearing part of the buckle and is preferably molded of plastic and formed of two pieces which are snap fitted or otherwise secured together to form a relatively complete housing. The upper half of the housing has formed therein the centrally disposed pushbutton aperture 57, which is defind by a downwardly and inwardly sloped, four-sided wall 180. At the rearward end of the upper housing half, a slot 181 is provided in alignment with the slot 50 in the buckle body flange 49 to admit the loop of webbing 13. A similar lower slot 182 is molded in the lower housing half for admittance of the loop of belting 13.

The lower housing wall 39 preferably has a bottom surface 184 which is generally flat, horizontal and uninterrupted. This lower wall 39 is formed on the lower housing half and abuts lower, longitudinally extending edges 183 of the depending flanges 60 and 61, as best seen in FIG. 2. As above described, the front end wall of the housing includes the upper wall 69 which engages the upturned buckle body lip 67 while the lower front end wall on the lower housing half engages the upstanding vertical end walls 77. The upstanding rearward ends 191 of the depending flanges 60 and 61, as best seen in FIG. 3, of the buckle body abut internal vertically extending walls 189 on the plastic housing 20 to assist in locating the buckle body in the housing.

The housing halves may be interlocked with each other and to the buckle body 37 in known and conventional manners. Herein, the lower half of the front end wall 69 of the housing is formed with a pair of internal slots to receive a pair of matching lugs (not shown) molded into the front end wall of the upper half of the housing. The lugs are inserted into the slot with the upper housing half disposed obliquely and then the rear of the upper housing half is swung downwardly causing internal grooves in its vertical side walls to accept arrow-shaped lugs which snap fit therein and lock the housing halves together. Lugs on the bottom housing half also interlock with openings in the buckle body 37.

One manner of assembly of the buckle 11 is to preassemble the spring body 33 and latch lever 35. More specifically, the forward pair of wings 133 on the spring body 117 may be disposed beneath the pair of pivot ears 107 and portions of the detents 155 are disposed above the transverse section 129 of the latch lever. The vertical side walls 145 of the spring body will be disposed at the walls 165 at the notched portions of the latch lever to limit lateral movement of the latter relative to the spring body and the forward, vertical edges 166 of these side walls 145 are positioned adjacent walls 164 of the ears 107 on the latch lever. If the buckle is disposed vertically with the wider portion of the flanges 60 and 61 facing upwardly, then the spring and lever assembly may be moved downward vertically to bring the pivot ears 107 into alignment with the slots 111 to enter therein with the forward edges 113 of the ears engaging the artucate bearing walls 115. At the same time, wings 133 will be moving into position on the top of the upwardly inclined wall 137 on the slots 111. The trailing ends of the detents 155 will be flexed inwardly by the converging side wall sections 65 until they pass the vertical wall 159 of the slot 111 whereupon they are free to flex laterally outwardly into the slots 111 and to be positioned to abut the vertical walls 159 to prevent a rearward movement of the spring body. This will also bring the upper end 55 of the latch lever 35 into alignment with the access openings 45 in the buckle body allowing the portion 55 to swing upwardly under the urging of the leaf springs 121 to assume the position shown in FIG. 2. The housing halves may then be placed about the buckle body and latch mechanism and interlocked to each other.

As an aid to understanding the invention, a brief description of the operation of the seat buckle will be given. To fasten the tongue plate 15 to the buckle 11, the tongue plate 15 is aligned with the entry slot 19 of the buckle, (FIG. 2), and is inserted and slid beneath the underside 73 of the overhead plate 43. As the leading end 25 of the tongue plate 15 moves forwardly, it will engage the top upwardly inclined surface 108 of the latch lever 35 to thereby pivot and cam the latch dog 29 downwardly pivoting it about a pivotal axis located at the arcuate surfaces 115 at the forward ends of the slots 111. At the same time, the pushbutton upper end 55 of the latch lever 35 will be moving downwardly within the access opening 45 in the buckle body 37. When the tongue plate 15 is inserted to a point where the abutment edge 153 at latch opening 31 in the tongue plate 15 is aligned with the abutment edge 161 of the dog 29, the dog 29 snaps upwardly into the opening 31 and into latching position under the urging of the spring means 33. The tongue plate will be limited to its maximum extent of inward movement when the shoulders 80 on the tongue plate abut the upstanding vertical shoulders 85 on the buckle body 37.

When the wearer wishes to release the tongue plate 15, he manually depresses the pushbutton portion 55 at the access opening 57 in the housing 20 while simultaneously exerting a retracting force on the belt webbing 17 and tongue plate 15. As the unitary latch lever 35 pivots downwardly, the latch dog 29 pivots its abutment edge 161 below the plane of the tongue plate. If the latch dog abutment edge 161 tends to pull the leading end 25 of the tongue plate 15 down with it, the tabs 105 of the stripper 99 will engage and hold the tongue plate and strip it from the tongue plate. After removal of the tongue plate 15, the pushbutton is released whereupon the leaf springs 121 pivot the latch lever 37 to raise and return the pushbutton upper end 55 upwardly to its raised position and thereby position the latch dog 29 upwardly to be engaged with the next insertion of the tongue plate.

From the foregoing, it will be seen that the present invention provides a buckle consisting of relatively few parts and which may be totally encased in a lightweight plastic housing. The buckle may be assembled inexpensively by dropping in the spring and unitary latch lever. Because the load transmitting buckle body is not exposed, it need not be chrome plated. Also, the preferred inverted channel-shaped buckle body is formed with an overhead plate which is generally co-extensive with the top side of the buckle. The overhead plate provides good crush resistance for the buckle.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A safety belt buckle comprising a tongue plate having an opening therein and an abutment surface, a load beaing buckle body made of metal having one end for connection to a strap for transmitting a load to and from said buckle body, an overhead plate on said buckle body having an opening therein, flanges on said buckle body depending from opposite lateral edges of said overhead plate and terminating in free lower edges spaced apart by a distance substantially equal to the width of said overhead plate, said overhead plate and said depending flanges defining an inverted channel shaped buckle body with a lower opening between said flanges, a unitary latch lever pivotally mounted on said buckle body and located beneath said overhead plate and having an upper end located at said opening, a latch dog on said latch lever having a latch surface for latching engagement with said abutment surface of said tongue plate for transmitting loads between the tongue plate and said latch lever, spring means biasing said latch lever to a latching position in which said latch dog projects into said tongue plate opening and its latch surface abuts said abutment surface on said tongue plate to hold said tongue plate against withdrawal, said latch lever being pivoted for movement to a release position in which said latch dog is retracted from said tongue plate opening allowing withdrawal of said tongue plate, a plastic housing for substantially enclosing said buckle body having a bottom wall covering a bottom side of said buckle at the space between said depending flanges, a side wall on said housing having an entry slot to allow entry of said tongue plate, a top wall on said housing having an access opening permitting pushing and depressing of said upper end of said latch lever and the shifting of said latch lever to said release position.

2. A buckle in accordance with claim 1 in which said overhead plate is substantially planar and extends substantially the length of said buckle, said opening being located substantially centrally in said overhead plate.

3. A buckle in accordance with claim 2 in which said overhead plate extends longitudinally beyond said depending flanges, and said overhead plate having another opening to receive one end of a safety belt.

4. A safety belt buckle comprising a tongue plate having an opening therein and having an abutment surface, a non-load bearing plastic housing, a forward end wall on said housing having an entry slot for receiving said tongue plate, a top wall on said housing having a pushbutton receiving opening substantially centrally located in said top wall of said housing, a metal load transmitting member disposed interiorly of said plastic housing and having a plate located adjacent said top wall of the housing, a rearward end of said load transmitting member being attached to a safety belt, said plate extending substantially across the entire top of said buckle and having an opening therein aligned with said access opening in said housing, a pair of spaced depending members integrally attached to opposite sides of said plate and extending downwardly therefrom to terminate in lower free edges spaced apart by a distance substantially equal to the width of said plate, a latching mechanism disposed beneath said plate and pivotally mounted on said depending members and carried by said load transmitting member, a spring biased latch dog in said latching mechanism biased to a latching position to project said latch dog into said opening in said tongue plate to abut its abutment surface and to hold the tongue plate against withdrawal, and manually operable pushbutton means at said pushbutton receiving opening for operating said latching mechanism to shift said latch dog to a release position in which said latch dog is retracted from said tongue plate opening allowing withdrawal of said tongue plate.

5. A safety belt buckle in accordance with claim 4 in which said latching mechanism comprises a unitary latching lever carrying said latching dog as an integral portion thereof, said pushbutton means includes the upper end of said unitary lever and a spring means for biasing said latching lever upwardly to a latching position with said tongue plate.

6. A safety belt buckle comprising a tongue plate having an abutment surface, an inverted channel-shaped buckle body having an overhead plate and a pair of depending flanges extending along the lateral sides of the overhead plate, said flanges having pivot openings therein and said overhead plate having an access opening therein, a unitary latch lever having an integral upstanding dog with an abutment surface for latching engagement with said abutment surface in said tongue plate, opposite lateral ends of said latch lever projecting into said flange openings and having surfaces in pivotal engagement with said depending flanges, said tongue plate being slidable along the underside of said oerhead plate to abut said latch dog and to pivot the same downwardly upon insertion of the leading end of the tongue plate into said inverted channel, and spring means within said inverted buckle body biasing said latch dog upwardly to latching engagement with said tongue plate, a housing substantially covering said buckle body, latch lever and said spring means and having an access opening to allow depression of the upper end of said latch lever to shift said latch dog downwardly from engagement with said tongue allowing withdrawal of said tongue plate.

7. A buckle in accordance with claim 6 in which said spring means comprises a spring body spanning said depending flanges and projecting into said openings therein to hold and locate said latch lever for pivotal movement on said depending flanges.

8. A safety belt buckle comprising a tongue plate having an opening therein and an abutment surface, a load bearing buckle body made of metal having one end for connection to a strap for transmitting a load to and from said buckle body, an overhead plate on said buckle body having an opening therein, flanges on said buckle body depending from opposite lateral edges of said overhead plate, a unitary latch lever pivotally mounted on said buckle body and located beneath said base plate and having an upper end located at said opening, a latch dog on said latch lever having a latch surface for latching engagement with said abutment surface of said tongue plate for transmitting loads between the tongue plate and said latch lever, spring means biasing said latch lever to a latching position in which said latch dog projects into said tongue plate opening and its latch surface abuts said abutment surface on said tongue plate to hold said tongue plate against withdrawal, said latch lever being pivoted for movement to a release position in which said latch dog is retracted from said tongue plate opening allowing withdrawal of said tongue plate, a plastic housing for substantially enclosing said buckle body having a bottom wall covering a bottom side of said buckle at the space between said depending flanges, a side wall on said housing having an entry slot to allow entry of said tongue plate, a top wall on said housing having an access opening permitting pushing and depressing of said upper end of said latch lever and the shifting of said latch lever to said release position, each of said depending flanges having a slot therein, said latch lever being positioned between said flanges, and pivot ears on said latch lever projecting laterally into said slots and engaging said depending flanges and thereby pivotally mounting said latch lever on said depending flanges.

9. A safety belt buckle comprising a tongue plate having an opening therein in an abutment surface, a load bearing buckle body made of metal having one end for connection to a strap for transmitting a load to and from said buckle body, an overhead plate on said buckle body having an opening therein, flanges on said buckle body depending from opposite lateral edges of said overhead plate, a unitary lach lever pivotally mounted on said buckle body and located beneath said base plate and having an upper end located at said opening, a latch dog on said latch lever having a latch surface for latching engagement with said abutment surface of said tongue plate for transmitting loads between the tongue plate and said latch lever, spring means biasing said latch lever to a latching position in which said latch dog projects into said tongue plate opening and its latch surface abuts said abutment surface on said tongue plate to hold said tongue plate against withdrawal, said latch lever being pivoted for movement to a release position in which said latch dog is retracted from said tongue plate opening allowing withdrawal of said tongue plate, a plastic housing for substantially enclosing said buckle body having a bottom wall covering a bottom side of said buckle at the space between said depending flanges, a side wall on said housing having an entry slot to allow entry of said tongue plate, a top wall on said housing having an access opening permitting pushing and depressing of said upper end of said latch lever and the shifting of said latch level to said release position, a tongue stripper being struck downwardly from and integrally attached to said overhead plate, a portion of said tongue stripper extending beneath the tongue plate to limit downward travel of said tongue plate during downward movement of said latch surface on said latch lever.

10. A safety belt buckle comprising a tongue plate having an opening therein and an abutment surface, a load bearing buckle body made of metal having one end for connection to a strap for transmitting a load to and from said buckle body, an overhead plate on said buckle body having an opening therein, flanges on said buckle body depending from opposite lateral edges of said overhead plate, a unitary latch lever pivotally mounted on said buckle body and located beneath said base plate and having an upper end located at said opening, a latch dog on said latch lever having a latch surface for latching engagement with said abutment surface of said tongue plate for transmitting loads between the tongue plate and said latch lever, spring means biasing said latch lever to a latching position in which said latch dog projects into said tongue plate opening and its latch surface abuts said abutment surface on said tongue plate to hold said tongue plate against withdrawal, said latch lever being pivoted for movement to a release position in which said latch dog is retracted from said tongue plate opening allowing withdrawal of said tongue plate, a plastic housing for substantially enclosing said buckle body having a bottom wall covering a bottom side of said buckle at the space between said depending flanges, a side wall on said housing having an entry slot to allow entry of said tongue plate, a top wall on said housing having an access opening permitting pushing and depressing of said upper end of said latch lever and the shifting of said latch lever to said release position, said spring means spanning said depending flanges and being supported by said depending flanges.

11. A buckle in accordance with claim 10 in which said spring means comprises at least a pair of leaf springs disposed beneath said latch lever and in engagement with said latch lever biasing said latch surface thereon to project into said opening in said tongue plate for abutment with said abutment surface.

12. A buckle in accordance with claim 10 in which said latch lever is pivoted in openings in said depending flanges and in which said leaf spring means locates and holds said latch lever in said openings in said flanges.

13. A safety belt buckle comprising a tongue plate having an opening therein and having an abutment surface, a non-load bearing plastic housing, a forward end wall on said housing having an entry slot for receiving said tongue plate, a top wall on said housing having a pushbutton receiving opening substantially centrally located in said top wall of said housing, a metal load transmitting member disposed interiorly of said plastic housing and having a plate located adjacent said top wall of the housing, a rearward end of said load transmitting member being attached to a safety belt, said plate extending substantially across the entire top of said buckle and having an opening therein aligned with said access opening in said housing, a latching mechanism disposed beneath said plate and carried by said load transmitting member, a spring biased latch dog in said latching mechanism biased to a latching position to project said latch dog into said opening in said tongue plate to abut its abutment surface and to hold the tongue plate against withdrawal, and manually operable pushbutton means at said pushbutton receiving opening for operating said latching mechanism to shift said latch dog to a release position in which said latch dog is retracted from said tongue plate opening allowing withdrawal of said tongue plate, said latching mechanism comprising a unitary latching lever carrying said latching dog as an integral portion thereof, said push-button means including the upper end of said unitary lever and a spring means for biasing said latching lever upwardly to a latching position with said tongue plate, said load transmitting member being generally channel-shaped having a pair of depending flanges and said plate being integrally attached to upper lateral edges of said depending flanges, said latching mechanism being pivotally mounted on said depending flanges.

* * * * *

UNITED STATES PATENT AND TRADEMARK OFFICE

CERTIFICATE OF CORRECTION

PATENT NO. : 3,996,648

DATED : Dec. 14, 1976

INVENTOR(S) : Louis Romanzi, Jr.

It is certified that error appears in the above-identified patent and that said Letters Patent are hereby corrected as shown below:

Column 1, line 39, "provided" should be --proved--.

Column 7, line 33, "layer" should be --lever--.

Column 9, line 31, "beaing" should be --bearing--.

Column 11, line 45, Claim 9 "lach" should be --latch--.

Column 11, line 67, Claim 9 "level" should be --lever--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*